US010218107B2

(12) United States Patent
Bishop

(10) Patent No.: US 10,218,107 B2
(45) **Date of Patent: *Feb. 26, 2019**

(54) CAGED POKE HOME CONTACT

(71) Applicant: AVX Corporation, Fountain Inn, SC (US)

(72) Inventor: Peter G. Bishop, Cambs (GB)

(73) Assignee: AVX Corporation, Fountain Inn, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/714,085

(22) Filed: Sep. 25, 2017

(65) Prior Publication Data

US 2018/0013226 A1 Jan. 11, 2018

Related U.S. Application Data

(63) Continuation of application No. 15/206,379, filed on Jul. 11, 2016, now Pat. No. 9,774,122, which is a continuation of application No. 14/507,401, filed on Oct. 6, 2014, now Pat. No. 9,391,386.

(51) Int. Cl.

| | |
|---|---|
| ***H01R 13/428*** | (2006.01) |
| ***H01R 12/71*** | (2011.01) |
| ***H01R 4/48*** | (2006.01) |
| ***H01R 12/53*** | (2011.01) |

(52) U.S. Cl.

CPC ..... *H01R 13/428* (2013.01); *H01R 4/4809* (2013.01); *H01R 12/53* (2013.01); *H01R 12/718* (2013.01)

(58) Field of Classification Search

CPC .... H01R 13/428; H01R 4/4809; H01R 12/53; H01R 12/718

USPC ..... 439/81, 845, 849, 850, 867, 852, 877, 439/886–887

See application file for complete search history.

(56) References Cited

U.S. PATENT DOCUMENTS

| | | | |
|---|---|---|---|
| 1,622,631 | A | 3/1927 | Fahnestock |
| 2,122,252 | A | 6/1938 | Hayes |
| 2,603,681 | A | 7/1952 | Salisbury |
| 2,689,337 | A | 9/1954 | Burtt et al. |
| 3,076,953 | A | 2/1963 | Sloop |
| 3,162,501 | A | 12/1964 | Wahl |

(Continued)

FOREIGN PATENT DOCUMENTS

| | | | |
|---|---|---|---|
| CN | 1255755 | A | 6/2000 |
| CN | 1967943 | A | 5/2007 |

(Continued)

OTHER PUBLICATIONS

Extended European Search Report dated Feb. 2, 2016, from related application No. 15188199.2.

(Continued)

*Primary Examiner* — Edwin A. Leon
(74) *Attorney, Agent, or Firm* — Foley & Lardner LLP

(57) ABSTRACT

A single element connector includes a first cage-like structure configured to receive a wire. The first cage-like structure includes an insert end and a single contact tine coupled to a top wall of the first cage-like structure. The single contact tine extends downward from the top wall to a base of the single element connector and directs a wire inserted into the single element connector to the base of the single element connector.

20 Claims, 9 Drawing Sheets

(56) References Cited

U.S. PATENT DOCUMENTS 3,221,293 A 11/1965 Regan
3,363,224 A 1/1968 Gluntz et al.
3,437,983 A 4/1969 Gilissen
3,479,634 A 11/1969 Pritulsky
3,510,831 A 5/1970 De Vito
3,555,497 A 1/1971 Watanabe
3,566,342 A 2/1971 Schmitt et al.
3,601,775 A 8/1971 Longenecker et al.
3,609,640 A 9/1971 Longenecker et al.
3,621,444 A 11/1971 Stein
3,654,583 A 4/1972 Mancini
3,663,931 A 5/1972 Brown
3,673,551 A 6/1972 McDonough
3,678,261 A 7/1972 McNeil
3,711,819 A 1/1973 Matthews
3,718,895 A 2/1973 Reynolds et al.
3,720,907 A 3/1973 Asick
3,778,755 A 12/1973 Marks
3,796,988 A 3/1974 Palombella
3,805,116 A 4/1974 Nehmann
3,818,423 A 6/1974 McDonough
3,824,557 A 7/1974 Mallon
3,846,735 A 11/1974 Carter et al.
3,850,500 A 11/1974 Cobaugh et al.
3,853,389 A 12/1974 Occhipinti
3,867,008 A 2/1975 Gartland, Jr.
3,907,392 A 9/1975 Haag et al.
3,915,537 A 10/1975 Harris et al.
3,915,544 A 10/1975 Yurtin
3,937,553 A 2/1976 Maximoff et al.
3,945,710 A 3/1976 Gartland, Jr.
3,950,065 A 4/1976 Renn
3,955,869 A 5/1976 Licht
3,963,302 A 6/1976 Gourley
3,963,316 A 6/1976 Williams
3,989,331 A 11/1976 Hanlon
3,992,076 A 11/1976 Gluntz
4,012,107 A 3/1977 Cobaugh et al.
4,076,369 A 2/1978 Ostapovitch
4,083,623 A 4/1978 Lynch
4,084,876 A 4/1978 Dinger
4,152,042 A 5/1979 Ostapovitch
4,193,660 A 3/1980 Jaconette
4,214,801 A 7/1980 Cairns et al.
4,232,931 A 11/1980 Takeuchi et al.
4,262,983 A 4/1981 Bogese, II
4,299,436 A 11/1981 Ackerman
4,317,609 A 3/1982 Lapraik
4,331,376 A 5/1982 Leather
4,359,258 A 11/1982 Palecek et al.
4,379,611 A 4/1983 Foege et al.
4,472,017 A 9/1984 Sian
4,527,857 A 7/1985 Hughes et al.
4,556,274 A 12/1985 Olivera
4,585,295 A 4/1986 Ackerman
4,605,277 A 8/1986 Defilippis et al.
4,618,205 A 10/1986 Freeman
4,640,561 A 2/1987 George
4,643,510 A 2/1987 Urani
4,657,336 A 4/1987 Johnson et al.
4,708,416 A 11/1987 Awano
4,728,304 A 3/1988 Fischer
4,740,180 A 4/1988 Harwath et al.
4,767,342 A 8/1988 Sato
4,772,234 A 9/1988 Cooper
4,781,602 A 11/1988 Cobaugh
4,784,622 A 11/1988 Senor
4,813,881 A 3/1989 Kirby
4,822,288 A 4/1989 Conley
4,907,990 A 3/1990 Bertho et al.
4,932,891 A 6/1990 Spanke et al.
4,932,906 A 6/1990 Kaley et al.
4,934,967 A 6/1990 Marks et al.
4,952,178 A 8/1990 Beer
4,968,271 A 11/1990 Buscella
5,024,627 A 6/1991 Bennett et al.
5,035,658 A 7/1991 Berg
5,038,467 A 8/1991 Murphy
5,046,972 A 9/1991 Pass
5,049,095 A 9/1991 Gugelmeyer
5,064,379 A 11/1991 Ryll et al.
5,116,238 A 5/1992 Holloman
5,131,853 A 7/1992 Meyer
5,152,702 A 10/1992 Pilny
5,167,544 A 12/1992 Brinkman et al.
5,169,322 A 12/1992 Frantz et al.
5,213,530 A 5/1993 Uratsuji
5,263,883 A 11/1993 Kirayoglu
5,269,712 A 12/1993 Denlinger et al.
5,352,125 A 10/1994 Banakis et al.
5,362,244 A 11/1994 Hanson et al.
5,383,800 A 1/1995 Saka et al.
5,397,254 A 3/1995 Powell
5,399,108 A 3/1995 Lu et al.
5,415,571 A 5/1995 Lutsch
5,458,513 A 10/1995 Matsuoka
5,529,517 A 6/1996 Hopf et al.
5,551,897 A * 9/1996 Alwine ..... H01R 13/113 439/843
5,611,717 A 3/1997 Joly
5,615,944 A 4/1997 Siegfried et al.
5,618,187 A 4/1997 Goto
5,645,458 A 7/1997 Hotea
5,664,972 A 9/1997 Zinn et al.
5,676,570 A 10/1997 Scherer
5,713,767 A 2/1998 Hanson et al.
5,769,672 A 6/1998 Flieger
5,788,539 A 8/1998 Fedder
5,888,096 A 3/1999 Soes et al.
5,890,936 A * 4/1999 McDonald ..... H01R 13/114 439/852
5,941,740 A 8/1999 Neuer et al.
5,941,741 A 8/1999 Dobbelaere et al.
5,975,963 A 11/1999 Higuchi et al.
5,997,366 A 12/1999 Libregts
6,000,974 A 12/1999 Hotea
6,012,944 A 1/2000 Hatakeyama
6,039,584 A 3/2000 Ross
6,039,597 A 3/2000 Getselis et al.
6,050,845 A 4/2000 Smalley et al.
6,051,781 A 4/2000 Bianca et al.
6,056,585 A 5/2000 Hatakeyama et al.
6,080,008 A 6/2000 Frantz
6,089,880 A 7/2000 Miyagawa et al.
6,128,181 A 10/2000 Higami et al.
6,135,784 A 10/2000 Pei
6,171,126 B1 1/2001 Wu et al.
6,186,840 B1 2/2001 Geltsch et al.
6,193,567 B1 2/2001 Hsieh
6,210,240 B1 4/2001 Comerci et al.
6,254,422 B1 7/2001 Feye-Hohmann
6,257,912 B1 7/2001 Boillot et al.
6,264,498 B1 7/2001 Froberg
6,283,769 B1 9/2001 Asao et al.
6,309,236 B1 10/2001 Ullrich
6,315,591 B2 11/2001 Oda et al.
6,319,076 B1 11/2001 Gollhofer et al.
6,371,772 B1 4/2002 Yoneyama et al.
6,379,179 B2 4/2002 Shinohara
6,383,039 B1 5/2002 Yoneyama et al.
6,394,829 B1 5/2002 Patterson et al.
6,394,858 B1 5/2002 Geltsch et al.
6,439,934 B1 8/2002 Yu
6,439,935 B2 8/2002 Saka et al.
6,442,036 B2 8/2002 Komatsu
6,475,042 B1 11/2002 Yu
6,478,635 B2 11/2002 Charles et al.
6,511,336 B1 1/2003 Turek et al.
6,551,143 B2 4/2003 Tanaka et al.
6,561,828 B2 5/2003 Henrici et al.
6,652,303 B2 11/2003 Stockel et al.
6,776,635 B2 8/2004 Blanchfield et al.
6,805,591 B2 10/2004 Garland et al.
6,814,598 B2 11/2004 Hoffmann et al.

(56) References Cited

U.S. PATENT DOCUMENTS

| | | | |
|---|---|---|---|
| 6,827,613 | B2 | 12/2004 | Ferderer |
| 6,991,498 | B2 | 1/2006 | Wertz et al. |
| 7,048,597 | B2 | 5/2006 | Chen |
| 7,175,469 | B1 | 2/2007 | Daily et al. |
| 7,217,162 | B2 | 5/2007 | Harada et al. |
| 7,303,421 | B2 | 12/2007 | Liao |
| 7,306,477 | B1 | 12/2007 | Huang et al. |
| 7,320,616 | B1 | 1/2008 | Legrady et al. |
| 7,357,651 | B2 | 4/2008 | Minoura et al. |
| 7,503,814 | B1 | 3/2009 | Lin |
| 7,530,837 | B2 | 5/2009 | Nieleck et al. |
| 7,556,509 | B1 | 7/2009 | Oh et al. |
| 7,581,965 | B1 | 9/2009 | Upasani et al. |
| 7,654,874 | B2 | 2/2010 | Ader |
| 7,704,103 | B1 | 4/2010 | Rhein et al. |
| 7,731,550 | B2 | 6/2010 | Falchetti |
| 7,771,217 | B2 | 8/2010 | Bethurum et al. |
| 7,771,243 | B2 | 8/2010 | Peterson et al. |
| 7,780,489 | B2 | 8/2010 | Stuklek |
| 7,806,738 | B2 | 10/2010 | Wu et al. |
| 7,892,050 | B2 | 2/2011 | Pavlovic et al. |
| 7,967,648 | B2 | 6/2011 | Byrne |
| 7,988,506 | B2 | 8/2011 | Peterson et al. |
| 7,997,915 | B2 | 8/2011 | Pueschner et al. |
| 8,062,046 | B2 | 11/2011 | Daily et al. |
| 8,096,814 | B2 | 1/2012 | Schell et al. |
| 8,113,859 | B2 | 2/2012 | Kim |
| 8,182,229 | B2 | 5/2012 | Rajarajan et al. |
| 8,182,299 | B2 | 5/2012 | Schrader |
| 8,206,182 | B2 | 6/2012 | Kuo et al. |
| 8,206,184 | B2 | 6/2012 | Kwasny et al. |
| 8,221,167 | B2 | 7/2012 | Kuo et al. |
| D668,621 | S | 10/2012 | Gieski |
| 8,277,240 | B2 | 10/2012 | Urano |
| 8,328,586 | B2 | 12/2012 | Bies et al. |
| 8,339,235 | B2 | 12/2012 | Beckert et al. |
| 8,446,733 | B2 | 5/2013 | Hampo et al. |
| 8,512,050 | B2 | 8/2013 | McGreevy et al. |
| RE44,490 | E | 9/2013 | Kirstein et al. |
| 8,591,271 | B2 | 11/2013 | Bies |
| 8,721,376 | B1 | 5/2014 | Bishop |
| 9,391,386 | B2 | 7/2016 | Bishop |
| 9,768,527 | B2 | 9/2017 | Bishop |
| 9,774,122 | B2 * | 9/2017 | Bishop ..... H01R 13/428 |
| 2002/0009908 | A1 | 1/2002 | Liu et al. |
| 2002/0187670 | A1 | 12/2002 | Cisey |
| 2004/0038597 | A1 | 2/2004 | Norris |
| 2004/0077231 | A1 | 4/2004 | Harada et al. |
| 2005/0054244 | A1 | 3/2005 | Werner et al. |
| 2005/0287878 | A1 | 12/2005 | Urbaniak et al. |
| 2006/0189174 | A1 | 8/2006 | Fabian et al. |
| 2006/0292937 | A1 | 12/2006 | Morello et al. |
| 2007/0149015 | A1 | 6/2007 | Minoura et al. |
| 2008/0076277 | A1 | 3/2008 | Chen et al. |
| 2008/0124956 | A1 | 5/2008 | Wu |
| 2008/0214027 | A1 | 9/2008 | Schell et al. |
| 2009/0209143 | A1 | 8/2009 | Wu et al. |
| 2010/0173540 | A1 | 7/2010 | Lee et al. |
| 2011/0039458 | A1 | 2/2011 | Byrne |
| 2011/0076901 | A1 | 3/2011 | Glick et al. |
| 2011/0250803 | A1 | 10/2011 | Bies |
| 2012/0083141 | A1 | 4/2012 | Molnar et al. |
| 2012/0108113 | A1 | 5/2012 | Yamaguchi et al. |
| 2012/0295494 | A1 | 11/2012 | Chen |
| 2013/0168146 | A1 | 7/2013 | Kim et al. |
| 2013/0210247 | A1 | 8/2013 | Wang et al. |
| 2013/0316563 | A1 | 11/2013 | Brandberg et al. |
| 2014/0120783 | A1 | 5/2014 | Bishop |
| 2014/0242833 | A1 | 8/2014 | Mostoller et al. |

FOREIGN PATENT DOCUMENTS

| | | | |
|---|---|---|---|
| CN | 101911395 | A | 12/2010 |
| DE | 19735835 | A1 | 2/1999 |
| DE | 19735835 | B4 | 12/2004 |
| DE | 10 2010 014 143 | A1 | 10/2011 |
| DE | 10 2010 014 144 | A1 | 10/2011 |
| DE | 20 2011 104 301 | U1 | 11/2011 |
| DE | 10 2011 015 968 | A1 | 10/2012 |
| DE | 10 2011 079 318 | A1 | 1/2013 |
| DE | 20 2010 018 177 | U1 | 7/2014 |
| EP | 0 829 924 | A2 | 3/1998 |
| EP | 2 410 614 | A1 | 1/2012 |
| EP | 2 597 729 | A1 | 5/2013 |
| GB | 2 298 530 | | 9/1996 |
| GB | 2 510 020 | | 7/2014 |
| JP | S5036089 | U | 4/1975 |
| WO | WO-2010/146525 | A1 | 12/2010 |
| WO | WO-2011/015968 | | 2/2011 |
| WO | WO-2011/083031 | | 7/2011 |

OTHER PUBLICATIONS

First Office Action received in co-pending CN Appl. No. 201510574482.6 dated Nov. 3, 2016, with English translation (18 pages).

U.S. Office Action dated Jan. 21, 2016, from related U.S. Appl. No. 14/507,401.

U.S. Office Action on U.S. Appl. No. 15/206,379, dated Feb. 28, 2017.

Combined Search and Examination Report received for United Kingdom Patent Application No. GB1319036.8 dated Apr. 17, 2014 (6 pages).

Combined Search and Examination Report received in United Kingdom Application No. GB1410966.4 dated Nov. 18, 2014, 6 pages.

Final Office Action issued in U.S. Appl. No. 13/666,427 dated Dec. 6, 2013 (9 pages).

Final Office Action received in U.S. Appl. No. 13/927,231 dated Dec. 6, 2013 (5 pages).

Non-Final Office Action received in U.S. Appl. No. 13/666,427 dated Sep. 13, 2013 (12 pages).

Non-Final Office Action received in U.S. Appl. No. 13/927,231 dated Sep. 13, 2013 (19 pages).

Notice of Allowance received in U.S. Appl. No. 13/666,427 dated Feb. 19, 2014 (22 pages).

Office Action in DE Appl. 102015105383.7 dated Nov. 4, 2016 (no English translation; 4 pages).

Office Action received in Chinese Application No. 201410289785.9, dated Dec. 31, 2015, with English translation (23 pages).

Second Office Action issued in CN Appl. No. 201510179900.1 dated Aug. 9, 2017, with English translation (13 pages).

U.S. Notice of Allowance on U.S. Appl. No. 14/844,160 dated Aug. 16, 2016.

U.S. Office Action on 104298-0394 dated Aug. 17, 2015.

U.S. Office Action on U.S. Appl. No. 14/844,160 dated May 13, 2016.

U.S. Office Action on U.S. Appl. No. 15/706,905 dated Feb. 14, 2018 (6 pages).

First Office Action for CN Pat. Appl. No. 201610998926.3 dated Sep. 25, 2018 (15 pages).

* cited by examiner

CAGED POKE HOME CONTACT

CROSS-REFERENCE TO RELATED PATENT APPLICATIONS

This application is a Continuation of U.S. patent application Ser. No. 15/206,379, filed Jul. 11, 2016, now U.S. Pat. No. 9,774,122, which is a Continuation of U.S. patent application Ser. No. 14/507,401, filed Oct. 6, 2014, now U.S. Pat. No. 9,391,386, incorporated herein by reference in their entireties.

BACKGROUND

The following description is provided to assist the understanding of the reader. None of the information provided or references cited is admitted to be prior art.

Various types of connectors are used for forming connections between an insulated wire and any manner of electronic component, such as a printed circuit board (PCB). These connectors are typically available as sockets, plugs, and shrouded headers in a vast range of sizes, pitches, and plating options.

SUMMARY

Disclosed herein are embodiments of an electrical connector that is well suited for connecting at least one insulated conductive core wire to an electrical component, such as a PCB. Connectors according to illustrative embodiments are not limited to use with printed circuit boards, but may be used in any application where a secure electrical connection is desired between wires and any other type of component. The connectors described herein that are used to connect wires to PCB's are discussed for illustrative purposes only. The embodiments disclosed herein are rugged, reliable, and simple in design.

In accordance with illustrative embodiments, the connector is a single element connector in that it is formed from a single conductive contact member and does not include an insulative body or molding. The connector is designed to receive a wire and hold the wire in direct contact with an electrical contact on a PCB or other electrical component, thereby establishing an electrical connection between the wire and the PCB or other electrical component.

In one aspect, the present disclosure is directed to a single element connector. The single element connector includes a first cage-like structure configured to receive a wire. The single element connector further includes a contact tine coupled to a top wall of the first cage-like structure. The contact tine extends downward from the top wall to a base of the single element connector. In an embodiment, the single contact tine directs the wire inserted into the single element connector to the base of the single element connector. For example, in one embodiment, the contact tine extends downward from the top wall of the first cage-like structure at a 45 degree angle toward the base.

In an illustrative embodiment, the first cage-like structure includes a plurality of walls that are bent into a box-like structure having the top wall, a bottom wall, and at least two side walls. The bottom wall may include two bent over extensions of each respective side wall of the first cage-like structure. In some embodiments, the two bent over extensions extend inward toward the opposing side wall and extend perpendicular to the respective side wall, creating an opening between the respective ends of the two bent over extensions. In other embodiments, the two bent over extensions extend outward away from the opposing side wall and extend perpendicular to the respective side wall.

The single element connector may further include a second cage-like structure. In an illustrative embodiment, the second cage-like structure includes a plurality of walls bent into a box-like structure having the top wall, a bottom wall, and at least two side walls. The bottom wall of the second cage-like structure may include two bent over extensions of each respective side wall of the second cage-like structure. In some embodiments, the two bent over extensions extend inward toward the opposing side wall and extend perpendicular to the respective side wall, creating an opening between the respective ends of the two bent over extensions. In other embodiments, the two bent over extensions extend outward away from the opposing side wall and extend perpendicular to the respective side wall. The dimensions of the first cage-like structure can be greater than, equal to, or less than the dimensions of the second cage-like structure.

In an embodiment, the first cage-like structure and the second cage-like structure are coupled together by a first side portion and a second side portion. The first side portion and the second side portion may be generally parallel to each other. In some embodiments, the first cage-like structure, the second cage-like structure, the two side portions, and the contact tine, consist of a single piece of electrically-conductive material. In an embodiment, the base of the single element connector includes an exposed portion between the bottom wall of the first cage-like structure and the bottom wall of the second cage-like structure.

In some embodiments, the first cage-like structure includes a plurality of walls bent into a box-like structure having the top wall and at least two side walls, and the at least two side walls having a flange extending downward from a bottom of each of the side walls. Further, the second cage-like structure may include a plurality of walls bent into a box-like structure having the top wall and at least two side walls, and the at least two side walls include a flange extending downward from a bottom of each of the side walls. In other embodiments, the first cage-like structure includes a front wall and the insert end is formed into the front wall. The bottom wall of the first cage-like structure may include two bent over extensions of the front wall.

The connector is not limited by its mounting technique to a PCB or other component. In one embodiment, the contact surface is defined by a portion of the bottom wall of the cage structure such that the connector is surface mountable to a contact pad on a PCB with the centerline axis generally parallel to the PCB. In another embodiment, the connector may be intended for a through-board or top mount configuration where the connector extends generally perpendicular to the PCB. In this configuration, the contact surface may be defined by contact feet extending generally transversely from the walls (bottom, top, or side walls).

Illustrative embodiments may also encompass any manner of electrical component assembly that incorporates the unique connector element introduced above and described in detail below to electrically connect one or more wires to an electrical component. For example, the component assembly may include a PCB in electrical mating contact with one or more conductive wires via the electrical connector.

The foregoing summary is illustrative only and is not intended to be in any way limiting. In addition to the illustrative aspects, embodiments, and features described above, further aspects, embodiments, and features will become apparent by reference to the following drawings and the detailed description.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

DETAILED DESCRIPTION

Figure 1A:
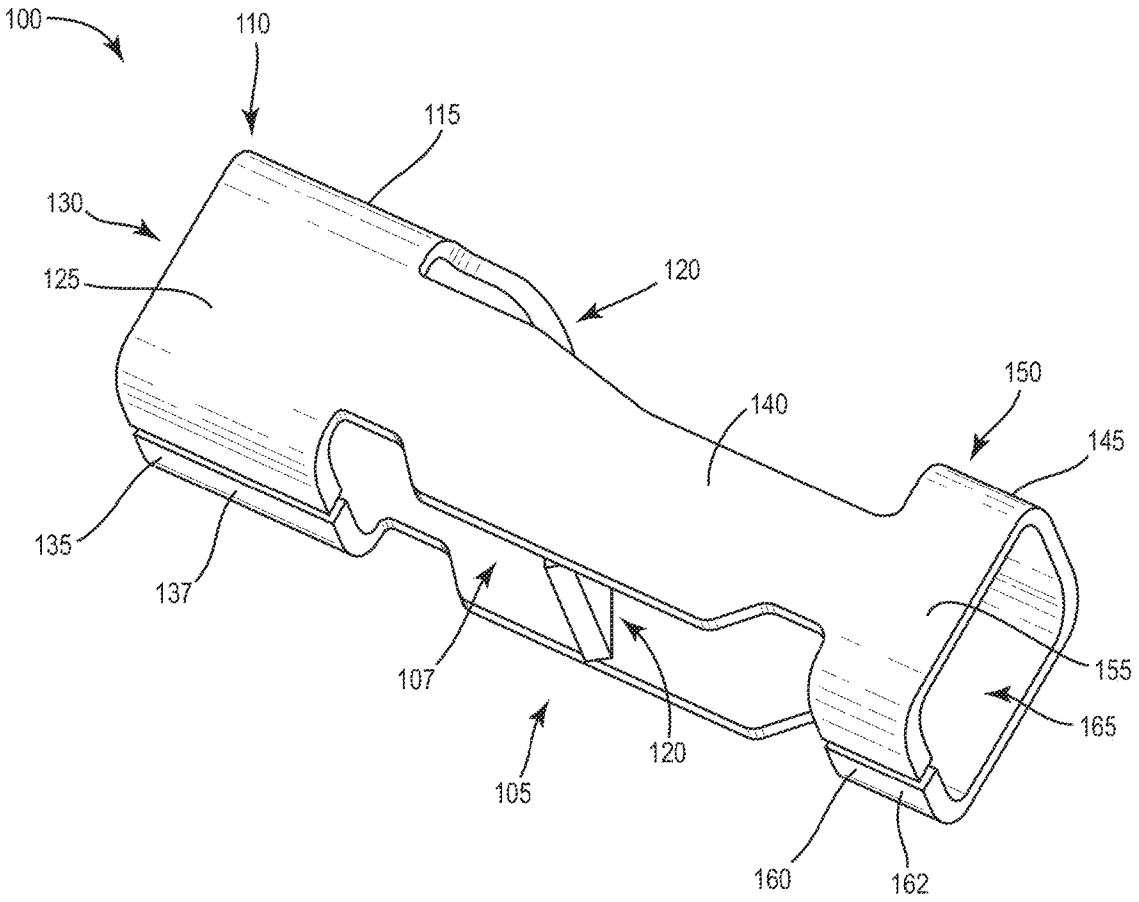
FIG. 1A depicts a perspective view of an embodiment of a connector in accordance with an illustrative embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and make part of this disclosure.

Disclosed herein are embodiments of an electrical connector that is well suited for connecting at least one insulated conductive core wire to an electrical component, such as a PCB. In an illustrative embodiment, a connector is a single element connector that includes a cage-like structure. The cage-like structure includes a wire insert end to receive the wire and a single contact point to direct the wire towards a PCB. The connector may be formed from a single stamped metal sheet bent or otherwise formed into the cage structure or multiple cage-like structures. The single contact point extends downward from a top wall of the cage-like structure towards a base of the single element connector. For example, in an illustrative embodiment, when the single element connector is mounted to a PCB and a wire is inserted into the connector, the single contact tine defines a contact pinch point for the wire to direct the wire to the PCB. The contact point holds the wire in contact with the PCB to establish an electrical connection between the wire and the PCB.

Reference will now be made to various embodiments of the invention, one or more examples of which are illustrated in the figures. The embodiments are provided by way of explanation, and are not meant as limiting. For example, features illustrated or described as part of one embodiment may be used with another embodiment to yield still a further embodiment. It is intended that the disclosed embodiments encompass these and other modifications and variations as come within the scope and spirit of the invention.

Illustrative embodiments of an electrical connector are illustrated in FIGS. 1A through 4B. The electrical connector connects an insulated wire to any manner of electrical component, such as a PCB. For ease of explanation and illustration, the connectors illustrated and referred to herein in the context of connecting wires to a PCB. In addition, the connectors are depicted in the figures as a single-way connector in that it includes only a single wire position. The connectors are not limited by the number of wire positions. Embodiments that have a cage structure that accommodates more than one wire position are possible. For example, various embodiments may have a cage structure that is formed into a two-way, a three-way connector, etc., in addition to the illustrated single-way connector.

Figure 1B:
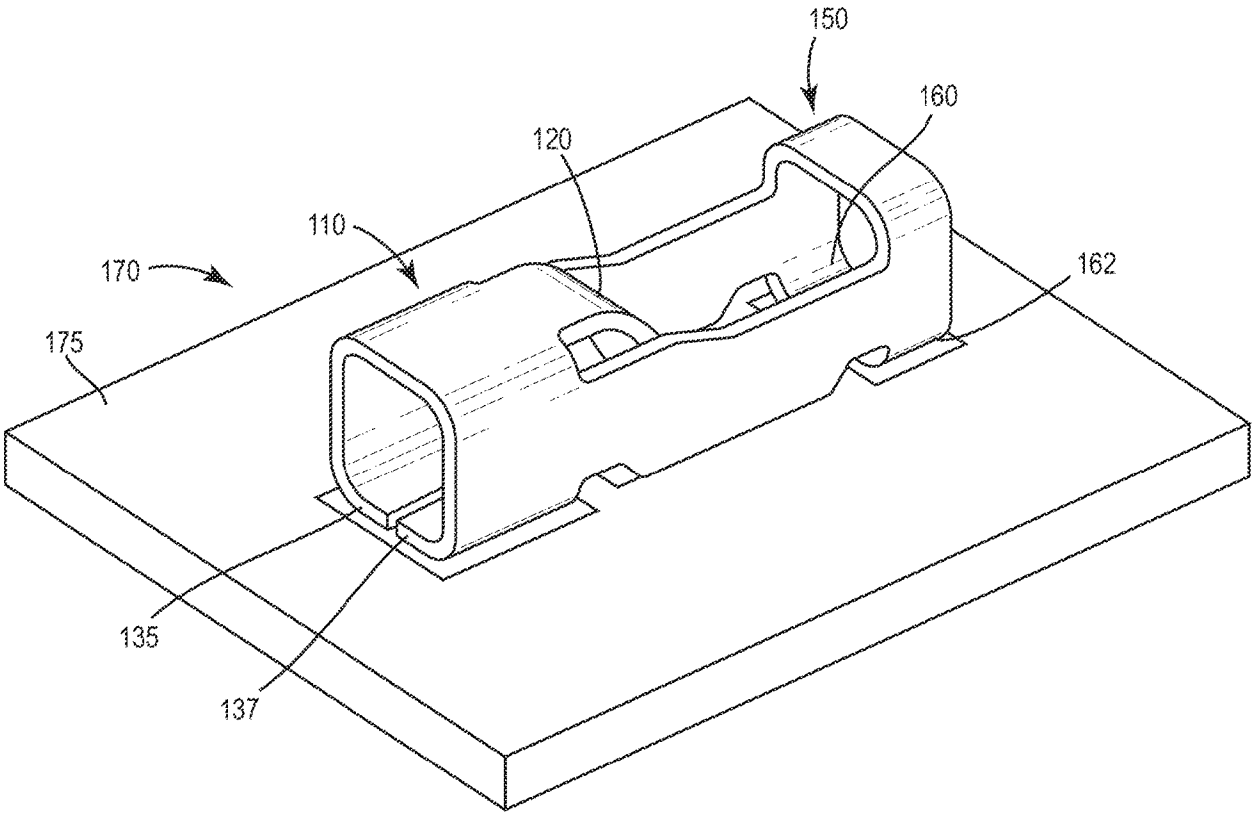
FIG. 1B depicts a mounting configuration for a connector in accordance with an illustrative embodiment.

Now referring to FIG. 1A, a perspective view of an embodiment of a connector 100 in accordance with an illustrative embodiment is shown. The connector 100 is suited for connecting a wire to any manner of electrical component, such as a PCB 170, as depicted in FIG. 1B. The wire may be a stranded or solid core wire having a core surrounded by insulation material.

As mentioned above, the connector 100 is a single element connector in that it can be formed from a single conductive contact element. This element may be any suitable conductive metal material having a gauge and other physical characteristics suitable for maintaining the shape of the connector 100 in the mounting process, as well as in the operating environment of the electrical component to which the connector 100 is mounted.

The single conductive contact element 100 can be formed into a cage or cage-like structure 110. In some embodiments, the single conductive contact element 100 is formed into multiple cage-like structures 110, 150 as depicted in FIG. 1A. In an embodiment, the connector 100 includes a first cage-like structure 110 and a second cage-like structure 150. The first cage-like structure 110 and the second cage-like structure 150 can be coupled together by at least two sides walls 140. The coupling of the two cage-like structures 110, 150 by the two side walls 140 forms an exposed portion 107 in a base 105 of the connector 100.

The first cage-like structure 110 can be formed by bending a single piece of conductive material into a cage-like structure. The second cage-like structure 150 can be formed by bending a single piece of conductive material into a cage-like structure. In some embodiments, the first cage-like structure 110, the second cage-like structure 150, and the side walls 140 are all formed or molded from a single piece of conductive material to form the connector 100. In other embodiments, the first cage-like structure 110, the second cage-like structure 150, and the side walls 140 are each separate components coupled to together to form the connector 100.

In an embodiment, the first cage-like structure 110 includes a plurality of walls that are bent into a box-like structure having a top wall 115, a bottom wall 135, and at least two side walls 125. The wall structure may include any number and configuration of walls, such as a circular wall, semicircular wall components, and so forth. A length of the top wall 115 and the bottom wall 135 can define a width of the first cage-like structure 110 and the connector 100. A length of the side walls 125 can define a height of the first cage-like structure 110 and the connector 100. In an embodiment, the bottom wall 135 includes two edges, for example, two flanges extending inward (i.e., towards the opposite side wall 125) and perpendicular to a vertical plane of the side walls 125. There may be a gap between the two edges of the bottom wall 135. In some embodiments, the size of the gap may range from about 2 mm to about 5 mm. The dimensions of the gap may vary based on the dimensions of the sire and/or the PCB board. In alternative embodiments, a gap may occur in different or additional walls other than the bottom wall 135. The first cage-like structure 110 may be formed in various ways. For example, the bottom wall 135 may be formed be bending a portion of each of the side walls 125 inward. In other embodiments, the side walls 125 are formed be bending a portion of the bottom wall 135 upward, while the top wall 115 is defined by an extension of one of the side walls 125 that is bent towards the opposite side wall 125. The first cage-like structure 110 generally includes an inlet opening 130 for inserting a wire into the connector 100.

In an embodiment, the second cage-like structure 150 includes a plurality of walls that are bent into a box-like structure having a top wall 145, a bottom wall 160, and at least two side walls 155. A length of the top wall 145 and the bottom wall 160 can define a width of the second cage-like structure 150 and the connector 100. A length of the side walls 155 can define a height of the second cage-like structure 150 and the connector 100. In an embodiment, the bottom wall 160 includes two edges, for example, two flanges extending inward (i.e., toward the opposite side wall 155) and perpendicular to a plane of the side walls 155. There may be a gap between the two edges of the bottom wall 160. The dimensions of the gap may range from about X to about X. The second cage-like structure 150 may be formed in various ways. For example, the bottom wall 160 may be formed by bending a portion of each of the side walls 155 inward. In other embodiments, the side walls 155 are formed be bending a portion of the bottom wall 160 upward, while the top wall 145 is defined by an extension of one of the side walls 155 that is bent towards the opposite side wall 155. The second cage-like structure 150 generally includes an opening 165.

In an embodiment, the second cage-like structure 150 is smaller than the first cage-like structure 110. In some embodiments, the first cage-like structure 110 and the second cage-like structure 150 are the same size. In other embodiments, the first cage-like structure 110 is smaller than the second cage-like structure 150.

Certain embodiments of the connector 100 may also include guide surfaces within the first cage-like structure 110 that serve to physically contact and align the wire within the first cage-like structure 110 and the connector 100. For example, the connector 100 may further include a single contact tine 120 coupled to the top wall 115 of the first-cage like structure 110. The contact tine 120 can extends downward from the top wall 115 to the base 105 of the connector 100. The contact tine 120 may be a spring beam configured to hold a wire in place once inserted into the connector 100. In more detail, the contact tine 120 directs the wire inserted into the connector 100 towards the base 105. For example, and as illustrated in FIG. 1B, the connector 100 can be coupled to a top surface 175 of a printed circuit board (PCB) 170. The contact tine 120 applies pressure to a surface of the wire directing it downward and towards the PCB 170. The wire connects to the PCB 170 through the exposed portion 107 of the base 105 of the connector 100. The contact tine 120 holds the wire in place to establish an electrical connection between the wire and the PCB. In some embodiments, the single contact tine 120 extends downward at a 45 degree angle relative to a horizontal plane of the top wall 115. The angle of the single contact tine 120 may vary according to the dimensions of the connector 100 and/or the dimensions of the wire.

In some embodiments, the length and distance to which the contact tine 120 extends from the top wall 115 can vary depending on the dimensions of the connector 100 and/or the dimensions of the wire. For example, in an embodiment, the contact tine 120 may extend downward to the base 105 such that an edge of the contact tine 120 is flush with the exposed portion 107 of the base 105. In other embodiments, the contact tine 120 may extend a portion of the distance between the top wall 115 and the base 105. For example, in an embodiment, the contact tine 120 extends to a point halfway between the top wall 115 and the base 105. In some embodiments, the contact tine 120 may extend 80% of the distance between the top wall 115 and the base 105. In other embodiments, the contact tine 120 may extend through the base 105 such that an edge of the contact tine 120 is beyond the plane of the exposed portion 107.

The single contact tine 120 may be formed of the single piece of material forming the first cage-like structure 110. In some embodiments, the single contact tine 120 is defined by a section or cutout of the first-cage-like structure 120 and defines a contact point for the connector 100 to the wire. The contact tine 120 may serve as a clamp point to prevent inadvertent removal of the wire from the connector 100.

In an embodiment, the base 105 of the connector 100 includes the bottom wall 135 of the first cage-like structure 110, the bottom wall 160 of the second cage-like structure, and the exposed portion 107. The exposed portion 107 may be defined by the area between the bottom wall 135 of the first cage-like structure 110 and the bottom wall 160 of the second cage-like structure. The exposed portion 107 may provide an area for the wire to connect with a PCB when the connector 100 is mounted on the PCB.

In an embodiment, the base 105 provides a mating contact with a respective contact element on the electronic component. For example, the base 105 may be defined by any section of each of the respective bottom wall 135, 160 of the both cage-like structures 110, 150 that mates with a corresponding contact pad on the PCB, where the connector 100 may be surface mounted directly onto the contact pad of the PCB. For example, as illustrated in FIG. 1B, the flanges 137, 162 are contact points to connect the connector 100 to the PCB 170. In some embodiments, the connector 100 is soldered to the surface 175 of the PCB 170.

In various embodiments, e.g., FIGS. 2A-3B, the configuration of the base of the single contact element can vary depending on the type of connection and/or mating to the electronic component. In an embodiment, the single element connectors as illustrated in FIGS. 2A-3B are similar structurally and functionally to the connector 100 described above with respect to FIG. 1A, however, the base of the connectors are configured differently.

Figure 2A:
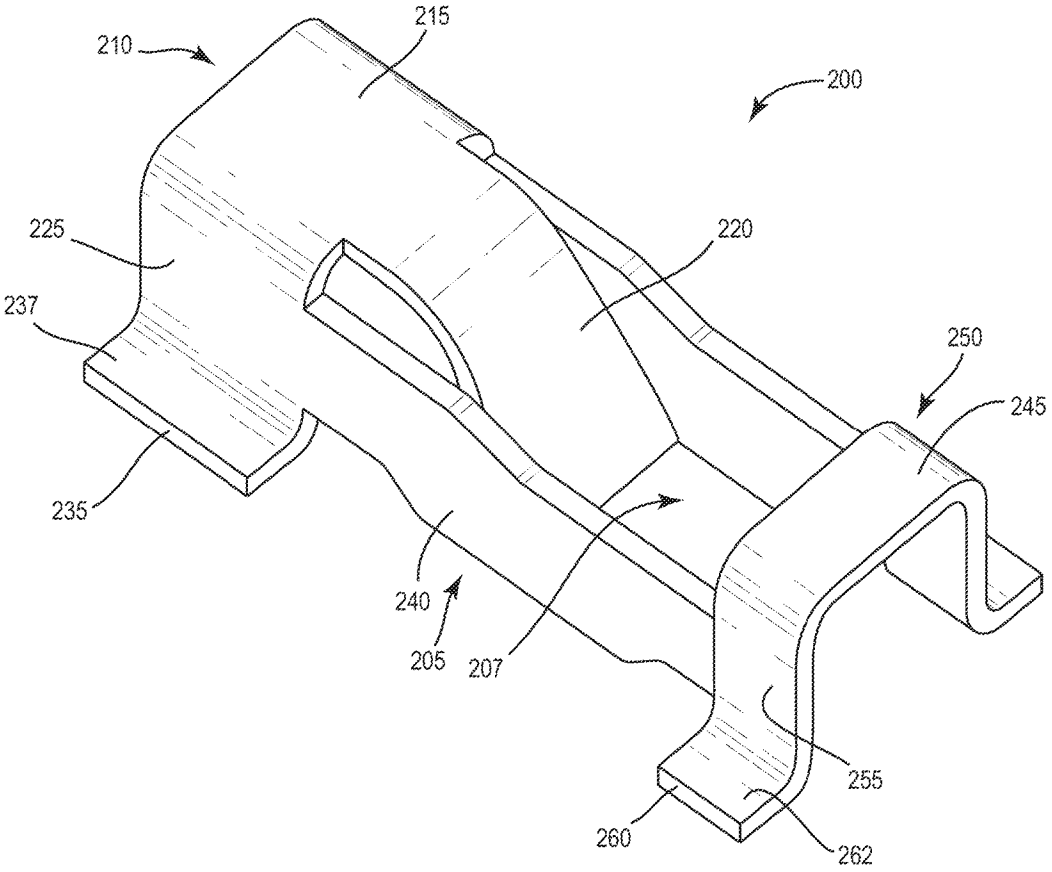
FIG. 2A depicts a perspective view of an alternative embodiment of a connector in accordance with an illustrative embodiment.

For example, FIG. 2A depicts a perspective view of an alternative embodiment of a connector 200 in accordance with an illustrative embodiment. In an embodiment, the connector 200 includes a first cage-like structure 210 and a second cage-like structure 250. The first cage-like structure 210 and the second cage-like structure 250 can be coupled together by at least two side walls 240. The coupling of the two cage-like structures 210, 250 by the two side walls 240 forms an exposed portion 207 in a base 205 of the connector 200.

In an embodiment, the first cage-like structure 210 includes a plurality of walls that are bent into a box-like structure having a top wall 215, a bottom wall 235, and at least two side walls 225. The second cage-like structure 250 includes a plurality of walls that are bent into a box-like structure having a top wall 245, a bottom wall 260, and at least two side walls 255. The connector 200 may further include a single contact tine 220 coupled to the top wall 215 of the first-cage like structure 210. The contact tine 220 extends downward from the top wall 215 to the base 205 of the connector 200.

Figure 2B:
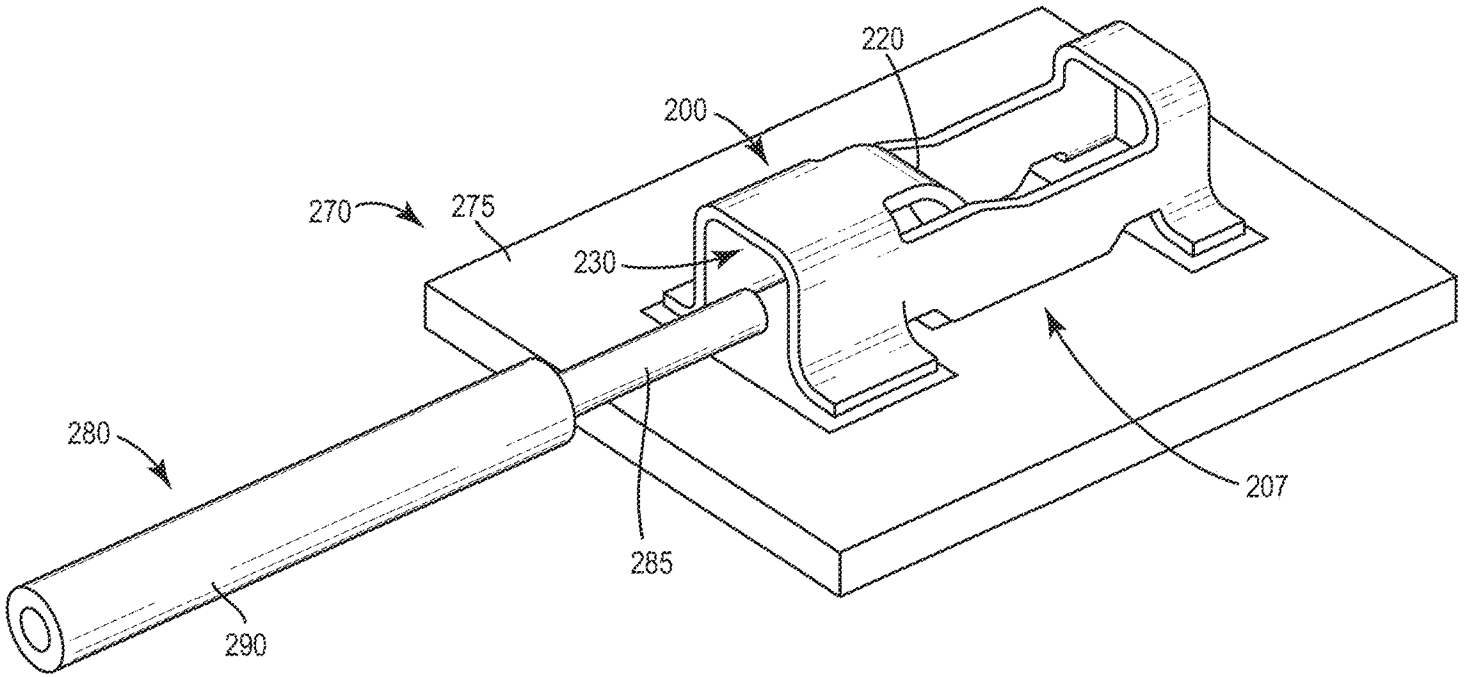
FIG. 2B depicts an alternative mounting configuration for a connector in accordance with an illustrative embodiment.
Figure 2C:
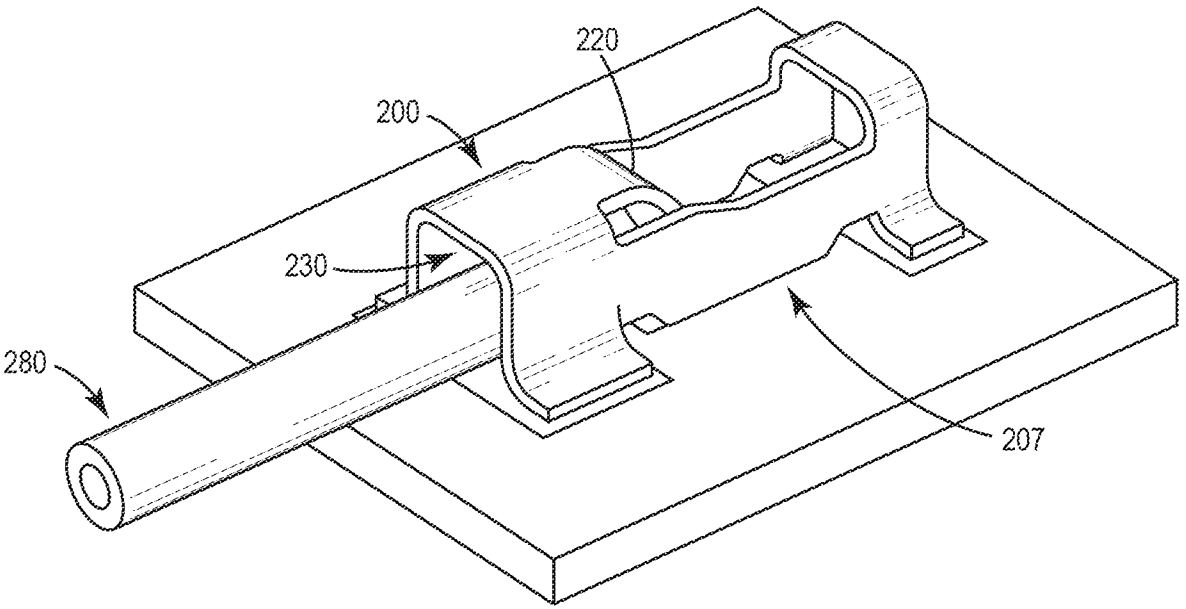
FIG. 2C depicts a perspective view of an alternative embodiment of a connector in accordance with an illustrative embodiment.

In an embodiment, the contact tine 220 is a spring beam configured to hold a wire in place once inserted into the connector 200. In more detail, the contact tine 220 directs the wire inserted into the connector 200 towards the base 205. For example, and as illustrated in FIG. 2B, the connector 200 can be coupled to a top surface 275 of a printed circuit board (PCB) 270. A wire 280 is inserted into an inlet opening 230 of the connector 200. In an embodiment, the wire 280 may be a stranded or solid core wire having a core 285 surrounded by insulation material 290. Prior to insertion of the wire 280 into the connector 200, a section of the insulation material 290 is stripped away from the core 285 adjacent to the end of the wire 280. The wire 280 is inserted into the connector 200 and directed towards the base 205 of the connector by the contact tine 220. For example, FIG. 2C illustrates the wire 280 fully inserted into the connector 200.

The contact tine 220 applies pressure to a surface of the wire 280 directing it downward and towards the PCB 270. The wire 280 connects to the PCB 270 through the exposed portion 207 of the base 205 of the connector 200. The contact tine 220 holds the wire 280 in place to establish an electrical connection between the wire 280 and the PCB 270. In some embodiments, the single contact tine 220 extends downward at a 45 degree angle relative to a horizontal plane of the top wall 215. The angle of the single contact tine 220 may vary according to the dimensions of the connector 200 and/or the dimensions of the wire 280.

Now referring back to FIG. 2A, the base 205 of the connector 200 includes a bottom wall 235 of the first cage-like structure 210, the bottom wall 260 of the second cage-like structure 260, and the exposed portion 207. The connector 200 as illustrated in FIG. 2A may be similar to the connector 100 as illustrated in FIG. 1A, except that each of the bottom walls 235, 260 extend outward instead of inward. For example, each of the bottom walls 235, 260 includes two edges, referred to herein as flanges 237, 262. Each of flanges 237, 262 extend outward (i.e., away from the opposite side wall 225, 255) and perpendicular to a vertical plane of the side walls 225, 255. The flanges 237, 262 may be formed by bending a bottom portion of each of the side walls 225, 255 upward and away from the opposing side wall 225, 255.

The flanges 237, 262 of the bottom walls 235, 260 may enable a connection to a top surface 275 of a PCB 270, as illustrated in FIG. 2B. In an embodiment, the flanges 237, 262 of the bottom wall 235, 260 create a flat surface and are parallel to the top surface 275 of the PCB 270 to create a flush connection between the connector 200 and the PCB 270. In some embodiments, the flanges 237, 262 are designed to connect to a mating component on the PCB 270. The connector 200 may be soldered to the PCB or locked into a mating connection on a surface 2705 of the PCB 270.

Figure 3A:
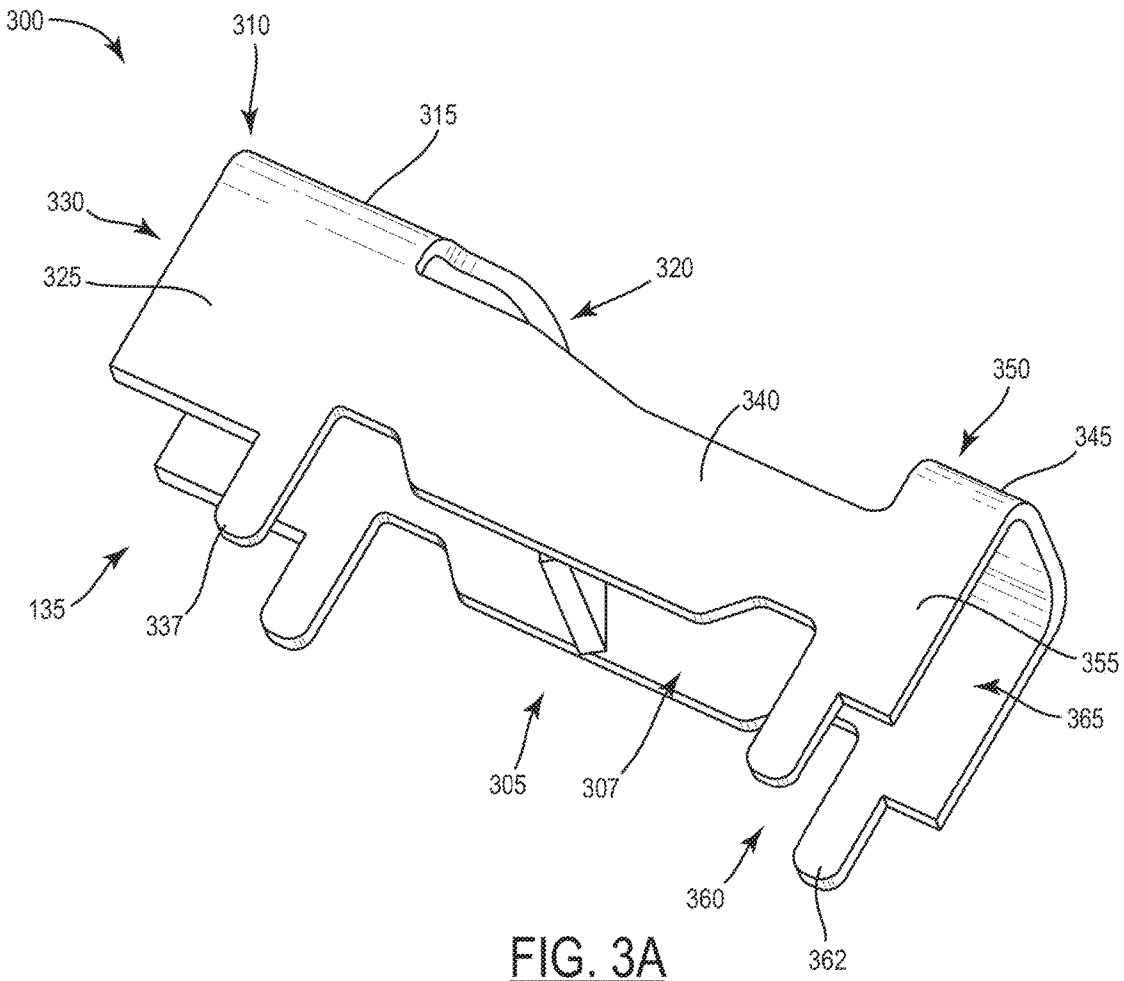
FIG. 3A depicts a perspective view of an alternative embodiment of a connector in accordance with an illustrative embodiment.

Now referring to FIG. 3A, which depicts a perspective view of an alternative embodiment of a connector 300 in accordance with an illustrative embodiment. In an embodiment, the connector 300 includes a first cage-like structure 310 and a second cage-like structure 350. The first cage-like structure 310 and the second cage-like structure 350 can be coupled together by at least two sides walls 340. The coupling of the two cage-like structures 310, 350 by the two side walls 340 forms an exposed portion 307 in a base 305 of the connector 300.

In an embodiment, the first cage-like structure 310 includes a plurality of walls that are bent into a box-like structure having a top wall 315, a bottom wall 335, and at least two side walls 325. The second cage-like structure 350 includes a plurality of walls that are bent into a box-like structure having a top wall 345, a bottom wall 360, and at least two side walls 355.

Figure 3B:
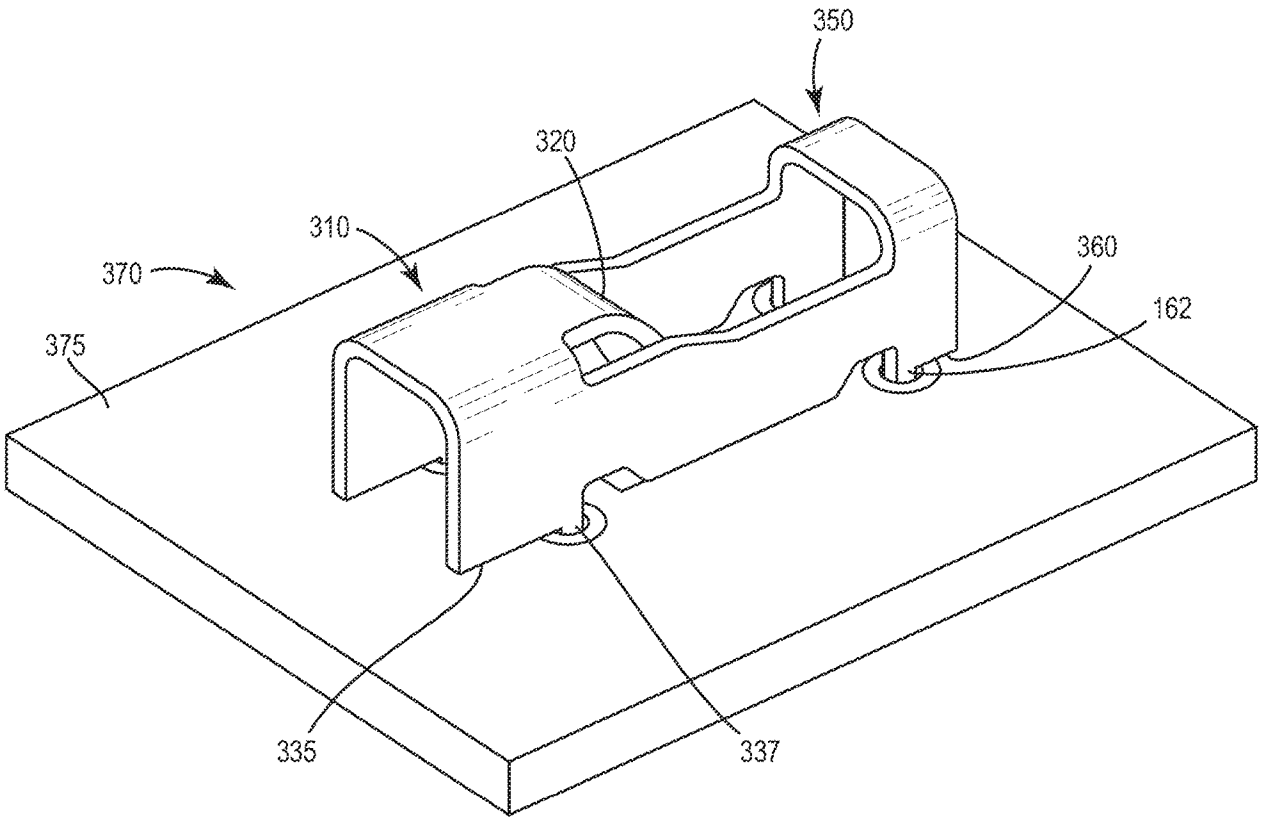
FIG. 3B depicts an alternative mounting configuration for a connector in accordance with an illustrative embodiment.

The connector 300 may further include a single contact tine 320 coupled to the top wall 315 of the first-cage like structure 310. The contact tine 320 can extends downward from the top wall 315 to the base 305 of the connector 300. In an embodiment, the contact tine 320 is a spring beam configured to hold a wire in place once inserted into the connector 300. In more detail, the contact tine 320 directs the wire inserted into the connector 300 towards the base 305. For example, and as illustrated in FIG. 3B, the connector 200 can be coupled to a top surface 375 of a printed circuit board (PCB) 370. The contact tine 320 applies pressure to a surface of the wire directing it downward and towards the PCB 370. The wire connects to the PCB 370 through the exposed portion 307 of the base 305 of the connector 300. The contact tine 320 holds the wire in place to establish an electrical connection between the wire and the PCB. In some embodiments, the single contact tine 320 extends downward at a 45 degree angle relative to a horizontal plane of the top wall 315. The angle of the single contact tine 320 may vary according to the dimensions of the connector 300 and/or the dimensions of the wire.

In an embodiment, the first cage-like structure 310 and the second cage-like structure may not have bottom walls and instead include flanges 337 that extend substantially straight downward from the bottom of both sets of side walls 325, 355. Each of the side walls 325, 355 includes at least one flange 337, 362 extending substantially straight downward. Each of the flanges 337, 362 may be a section or cutout of each of the respective side wall 325, 355.

The flanges 337, 362 may connect to a top surface 375 of a PCB 370, as illustrated in FIG. 3B. The top surface 375 of the PCB 370 may include a female end configuration to receive the flanges 337, 362 and to secure the connector 300 to the PCB 370. The flanges 337, 362 may be shaped in various ways to enable connection to the PCB 370. For example, the flanges 337, 362 may have a circular shape, spherical shape, or a square shape. In some embodiments, an outer surface of the flanges 337, 362 may be grooved and/or threaded to enable connection to the PCB 370. In various embodiments, the connector 300 may connect to any surface of the PCB 370.

FIGS. 1A-3B illustrate several embodiments of connectors with various base configurations to enable mating to an electrical component, such as a PCB. In some embodiments, the shape and/or dimensions of the cage-like structure may vary. For example and now referring to FIG. 4A, a perspective view of an alternative embodiment of a connector 400 in accordance with an illustrative embodiment is shown. The connector 400 may be structurally different from connector 100 as illustrated in FIG. 1A in that the connector 400 includes a single cage-like structure 410. In an embodiment, the connector 400 includes a plurality of walls that are bent into a box-like structure 410 including a top wall 415, a front wall 425, a contact tine 420, and bottom wall 435.

Figure 4A:
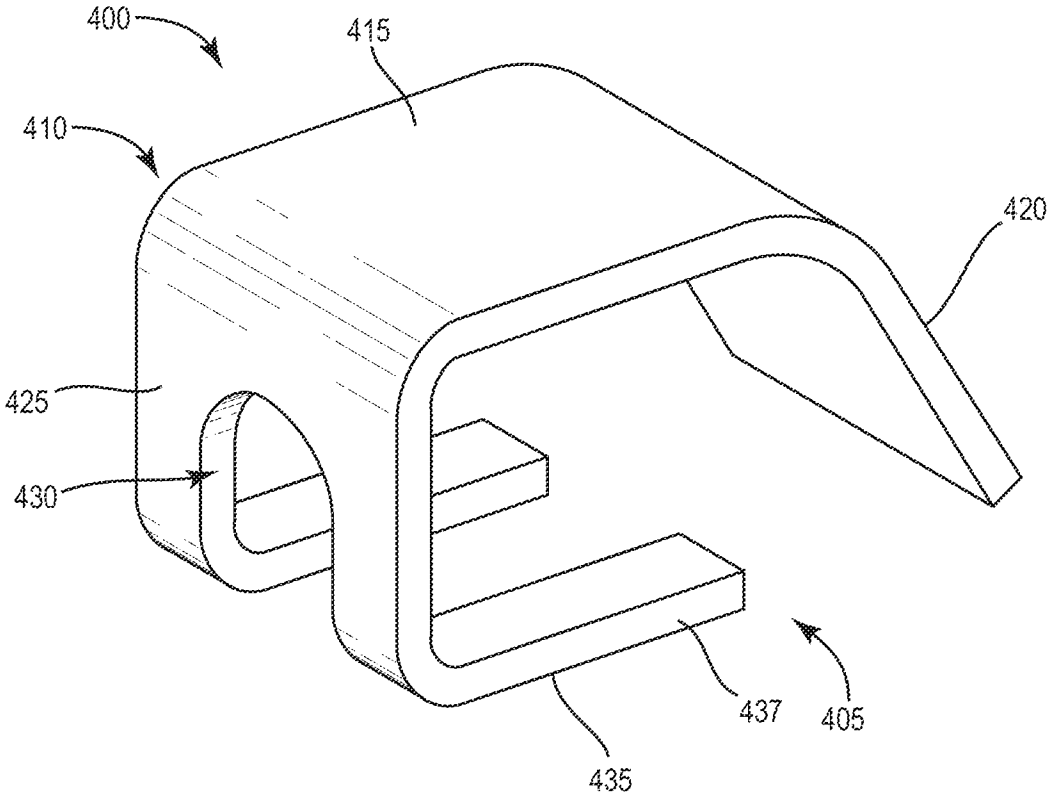
FIG. 4A depicts a perspective view of an alternative embodiment of a connector in accordance with an illustrative embodiment.

In an embodiment, the connector 400 is different from the embodiments of FIGS. 1A-3B, because it only includes the single cage-like structure 410 and does not include a second cage-like structure as illustrated in FIG. 4A. The connector 400 may be a minimalist design compared to the connectors as illustrated in FIGS. 1A-3B and only include the top wall 415, the front wall 425, the contact tine 420, and the bottom wall 435.

The connector 400 can be formed of a single piece of conductive material and the box-like structure of the connector 400 may be formed and defined by the walls in a variety of ways. For example, in some embodiments, the front wall 425 is formed by bending a portion of the top wall 415 downward. Further, the flanges 437 of the bottom wall 435 may be formed be bending a portion of the front wall 425 such that it extends perpendicular to a plane of the front wall 425 and is in a plane parallel to the top wall 415.

In an embodiment, the front wall 425 includes an inlet 430 to insert a wire. The inlet 430 can be formed into the front wall 425 and be a variety of shapes including circular, spherical, or square. The shape of the inlet 430 may depend of the shape and dimensions of the wire to be received and/or the shape and dimensions of the connector 400.

Figure 4B:
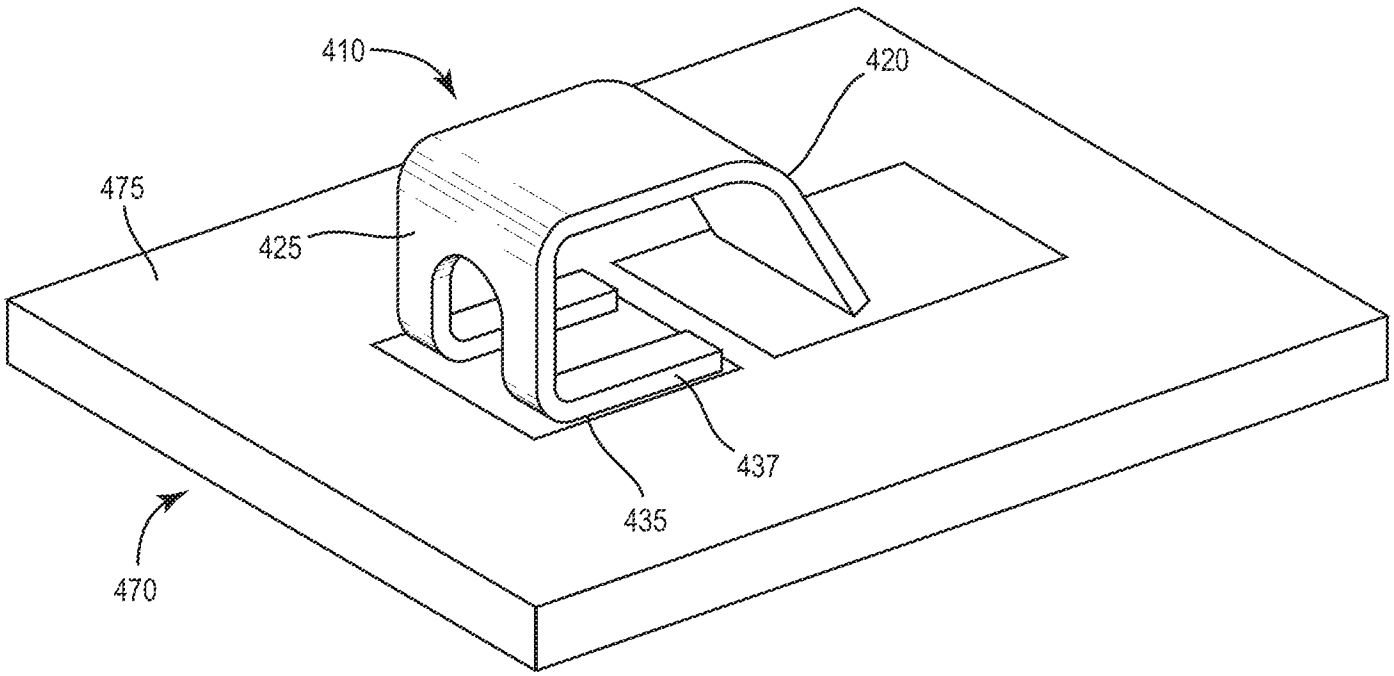
FIG. 4B depicts an alternative mounting configuration for a connector in accordance with an illustrative embodiment.

In an embodiment, the bottom wall 435 includes two flanges 437. Each of the flanges 437 extend outward and away from the front wall 425 and are perpendicular to a vertical plane of the front wall 425 and parallel to the top wall 415. In an embodiment and as illustrated in FIG. 4B, the two flanges 437 serve as a connection point to a top surface 475 of a PCB 470. Each of the flanges 437 can create a flat surface to connect flush to the top surface 475 of the PCB 470. The flanges 437 may connect to a mating component on the PCB 470 to secure the connector 400 to the PCB 470.

In an embodiment, the connector 400 further includes the single contact tine 420. The single contact tine 420 may be formed of the single piece of material forming the first cage-like structure 410. In some embodiments, the single contact tine 420 is defined by a section or cutout of the first-cage-like structure 420 and defines a contact point for the connector 400 to the wire.

In an embodiment, the contact tine 420 extends downward from the top wall 425 and towards a base 405 of the connector 400. The contact tine 420 can be defined by a section or cutout of the top wall 425 and defines a contact point for the connector 400 to the wire. The contact tine 420 may be formed by bending a portion of the front wall 425 downward and at an angle towards the base 405. In an embodiment, the contact extends downward at a 45 degree angle relative to a horizontal plane of the top wall 425. The angle of the contact tine 420 may vary depending on the dimensions of the wire to be received and/or the dimensions of the connector 400.

In an embodiment, the contact tine 420 directs the wire inserted into the connector 400 towards the base 405. For example, and as illustrated in FIG. 4B, the contact tine 420 applies pressure to a surface of the wire directing it downward and towards the PCB 470. The wire connects to the PCB 470 through the base 405 of the connector 400. The contact tine 420 may serve as a clamp point to prevent inadvertent removal of the wire from the connector 400.

In an alternate embodiment, the connector may be defined for a thru-board connection where the connector extends through a hole in a PCB. Contact feet may be provided extending laterally from opposing walls, such as the side walls, for mating against a contact pad on either side of the thru-hole in the PCB. In other embodiments, the contact feet may extend laterally from any of the walls or any combination of the walls (top, bottom, side). Similarly, the contact feet may serve for surface mounting of the connector on a PCB where the connector assumes a relatively vertical (i.e., perpendicular) orientation relative to the PCB. In an illustrative embodiment, the contact feet are defined by outwardly bent portions of each side wall. In an alternate embodiment, the contact feet may also be defined by outwardly bent portions of the bottom wall and top wall.

It should be readily appreciated by those skilled in the art that various modifications and variations can be made to the various embodiments and described herein without departing from the scope and spirit of the invention. It is intended that such modifications and variations be encompassed by the appended claims.

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

While certain embodiments have been illustrated and described, it should be understood that changes and modifications can be made therein in accordance with ordinary skill in the art without departing from the technology in its broader aspects as defined in the following claims.

The embodiments, illustratively described herein may suitably be practiced in the absence of any element or elements, limitation or limitations, not specifically disclosed herein. Thus, for example, the terms "comprising," "including," "containing," etc. shall be read expansively and without limitation. Additionally, the terms and expressions employed herein have been used as terms of description and not of limitation, and there is no intention in the use of such terms and expressions of excluding any equivalents of the features shown and described or portions thereof, but it is recognized that various modifications are possible within the scope of the claimed technology. Additionally, the phrase "consisting essentially of" will be understood to include those elements specifically recited and those additional elements that do not materially affect the basic and novel characteristics of the claimed technology. The phrase "consisting of" excludes any element not specified.

The present disclosure is not to be limited in terms of the particular embodiments described in this application. Many modifications and variations can be made without departing from its spirit and scope, as will be apparent to those skilled in the art. Functionally equivalent methods and compositions within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which can of course vary. It is also to be understood that the terminology used herein is for the purpose of describing particular embodiments only, and is not intended to be limiting.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like, include the number recited and refer to ranges which can be subsequently broken down into subranges as discussed above. Finally, as will be understood by one skilled in the art, a range includes each individual member.

All publications, patent applications, issued patents, and other documents referred to in this specification are herein incorporated by reference as if each individual publication, patent application, issued patent, or other document was specifically and individually indicated to be incorporated by reference in its entirety. Definitions that are contained in text incorporated by reference are excluded to the extent that they contradict definitions in this disclosure.

Other embodiments are set forth in the following claims.

What is claimed is:

1. A single element connector comprising:

a first wire reception structure configured to receive a wire; and a contact tine coupled to a first wall of the first wire reception structure, wherein the contact tine extends downward from the first wall toward a base of the single element connector, and wherein the contact tine is configured to direct the wire toward the base of the single element connector;

wherein the first wire reception structure further comprises a plurality of walls formed from a single conductive element, and wherein at least one wall of the plurality of walls comprises at least two extensions of the single conductive element that extend along a same plane to form the at least one wall.

2. The single element connector of claim 1, wherein the at least two extensions comprises at least two bent over extensions that extend inward toward opposing side walls and extend perpendicular to the respective opposing side walls.

3. The single element connector of claim 2, wherein a bottom wall of the plurality of walls comprises an opening between the respective ends of the at least two bent over extensions.

4. The single element connector of claim 1, wherein the at least two extensions extend outward away from the opposing side walls and away from the contact tine, and wherein the at least two extensions extend perpendicular to the opposing side walls.

5. The single element connector of claim 1, further comprising a second wire reception structure.

6. The single element connector of claim 5, wherein the second wire reception structure comprises a plurality of walls bent into a box-like structure having a top wall, a bottom wall, and at least two side walls.

7. The single element connector of claim 6, wherein the bottom wall of the second wire reception structure comprises bent over extensions of each respective side wall of the second wire reception structure.

8. The single element connector of claim 7, wherein the two bent over extensions extend inward toward the opposing side wall and extend perpendicular to the respective side wall.

9. The single element connector of claim 8, wherein the bottom wall comprises an opening between the respective ends of the two bent over extensions.

10. The single element connector of claim 6, wherein the two bent over extensions extend outward away from the opposing side wall and extend perpendicular to the respective side wall.

11. The single element connector of claim 5, wherein the first wire reception structure and the second wire reception structure are coupled together by a first side portion and a second side portion, and wherein the first side portion and the second side portion are generally parallel to each other.

12. The single element connector of claim 11, wherein the base further includes an exposed portion between a bottom wall of the first wire reception structure and a bottom wall of the second wire reception structure.

13. The single element connector of claim 5, wherein the contact element comprising the first wire reception structure, the second wire reception structure, the plurality of walls, and the contact tine, consists of a single piece of electrically-conductive material.

14. The single element connector of claim 1, wherein the contact tine is configured to direct the wire toward the base of the single element connector to connect with an electrically conducting printed circuit board.

15. The single element connector of claim 1, wherein the contact tine extends downward from the first wall of the first wire reception structure at a 45 degree angle toward the exposed portion of the base.

16. The single element connector of claim 1, further comprising a second wire reception structure, wherein the first wire reception structure comprises the plurality of walls bent into a box-like structure having the first wall and at least two side walls, and wherein the at least two side walls comprise a flange extending downward from a bottom of each of the side walls, and wherein the second wire reception structure comprises a second plurality of walls bent into a box-like structure having the first wall and at least two side walls, and wherein the at least two side walls comprise a flange extending downward from a bottom of each of the side walls.

17. The single element connector of claim 1, wherein the first wire reception structure comprises a front wall and an insert end formed into the front wall, and wherein a bottom wall of the first wire reception structure comprises two extensions of the front wall.

18. The single element connector of claim 1, wherein only a single contact tine is coupled to the first wall such that no other contact tines are coupled to the first wall except for the single contact tine.

19. The single element connector of claim 1, wherein the first wall extends substantially perpendicular to at least two side walls of the plurality of walls.

20. The single element connector of claim 1, wherein the two extensions are separated by a gap that extends an entire length of the two extensions.

* * * * *